United States Patent [19]

Andreoli

[11] Patent Number: 4,509,427

[45] Date of Patent: Apr. 9, 1985

[54] TAIL FIN FIRING DEVICE

[75] Inventor: Charles R. Andreoli, Ridgecrest, Calif.

[73] Assignee: The United States of America as represented by the Secretary of the Navy, Washington, D.C.

[21] Appl. No.: 474,762

[22] Filed: Mar. 14, 1983

[51] Int. Cl.[3] ..... F42C 15/00

[52] U.S. Cl. ..... 102/261; 102/274; 102/396

[58] Field of Search ..... 102/261, 260, 258, 272, 102/274, 275, 487, 488, 396, 429

[56] References Cited

U.S. PATENT DOCUMENTS

| | | | |
|---|---|---|---|
| 1,311,740 | 7/1919 | Asbury | 102/261 X |
| 1,512,249 | 10/1924 | Sprague et al. | 102/261 |
| 1,792,023 | 2/1931 | Macy | 102/261 X |
| 2,382,872 | 8/1945 | Giles | 102/396 X |
| 2,513,536 | 7/1950 | Wellington | 102/272 X |
| 3,261,293 | 7/1966 | Webb | 102/429 X |
| 3,356,025 | 12/1967 | Duncan | 102/261 X |
| 3,557,701 | 1/1971 | Arnell | 102/488 X |
| 3,831,521 | 8/1974 | Engeli | 102/261 X |
| 3,901,155 | 8/1975 | Huber | 102/261 |
| 4,004,488 | 1/1977 | Williams | 102/261 X |
| 4,038,924 | 8/1977 | Beermann et al. | 102/261 |
| 4,058,061 | 11/1977 | Mansur, Jr. et al. | 102/260 X |

FOREIGN PATENT DOCUMENTS

| | | | |
|---|---|---|---|
| 1086595 | 3/1958 | Fed. Rep. of Germany | 102/260 |
| 1228165 | 10/1962 | Fed. Rep. of Germany | 102/261 |

*Primary Examiner*—David H. Brown

*Attorney, Agent, or Firm*—Robert F. Beers; W. Thom Skeer; Kenneth G. Pritchard

[57] ABSTRACT

A straight pull cock and fire device is used which permits launching of tail fin fire devices. The pressure cartridge produces gas which is routed to a pusher piston through a combined ported manifold and firing device pusher assembly mounting unit. In-line pulls avoid rotational jamming. The spring-loaded actuator pin assures that a minimal level of force is required to initiate the device to avoid random jamming from triggering the device.

11 Claims, 4 Drawing Figures

TAIL FIN FIRING DEVICE

BACKGROUND OF THE INVENTION

1. Field of the Invention

This invention is a firing device or explosive actuator. In particular, it is an explosive actuator for tail fin launched weapons which rely on gas pressure to eject them safely from aircraft delivering the ordnance.

2. Description of the Prior Art

The concept of using a firing mechanism with locking ball spring and actuating pin is well known and has been used for several decades. Ideally, the use of a spring-loaded actuating pin simply requires that the actuating pin be pulled back until the force of the spring is sufficient that, when released, the actuating pin is propelled forward with sufficient thrust to serve as a detonating pin. Previous patents have used metal balls or other objects connected to a lanyard to avoid jamming of the lanyard while it was being pulled from a non-linear or in-line direction. The goal was to reduce friction rubbing of cable or lanyard to provide a smooth, predictable actuating force to trigger a release mechanism. Traditionally, lanyards were actually pulled by the pilot himself or by the bombardier while flying the plane.

The advent of modern ordnance has led to different criteria for determining the safest and most reliable way of releasing ordnance from aircraft. For non-self-propelled ordnance, it is sometimes desirable to use a tail fin actuator. The tail fins of the ordnance are retracted to facilitate loading problems on the delivery aircraft. After the ordnance is clear of the delivering aircraft, the tail fins are extended and locked in place. Traditional cock and pull fire devices are actuated by a routed cable and spool mechanism which allows a pressure cartridge to have a straight shot at the pusher piston. This type of device has repeated problems with the 90° routing of the lanyard cable and actuation of the cocking spool. Despite the problems of these current devices, they have traditionally been considered superior to the prior generation in-line devices because it was considered the least of the problems. An in-line actuating pin could not be in-line for a straight shot at the pusher piston.

SUMMARY OF THE INVENTION

The present apparatus uses a spring-loaded actuating pin which is kept at a discrete distance from a pressure cartridge by a safety pin and locking balls. The pressure cartridge, in turn, is in a U-shaped tube which terminates in back of a pusher piston for a tail fin device. Upon release of the safety pin, the actuator pin is withdrawn by a lanyard arranged to provide an in-line pull to the actuator pin. This compresses the spring, and when the spring has been compressed a sufficient distance, the locking balls release. Upon release of the locking balls, the actuator pin is propelled forward by the stored energy in the spring and triggers the pressure cartridge. Release of gas in the pressure cartridge builds up in the U-shaped tube, causing sufficient force on the tail fin's pusher piston to open and lock the weapon tail fins.

DESCRIPTION OF THE PREFERRED EMBODIMENT

Figure 1:
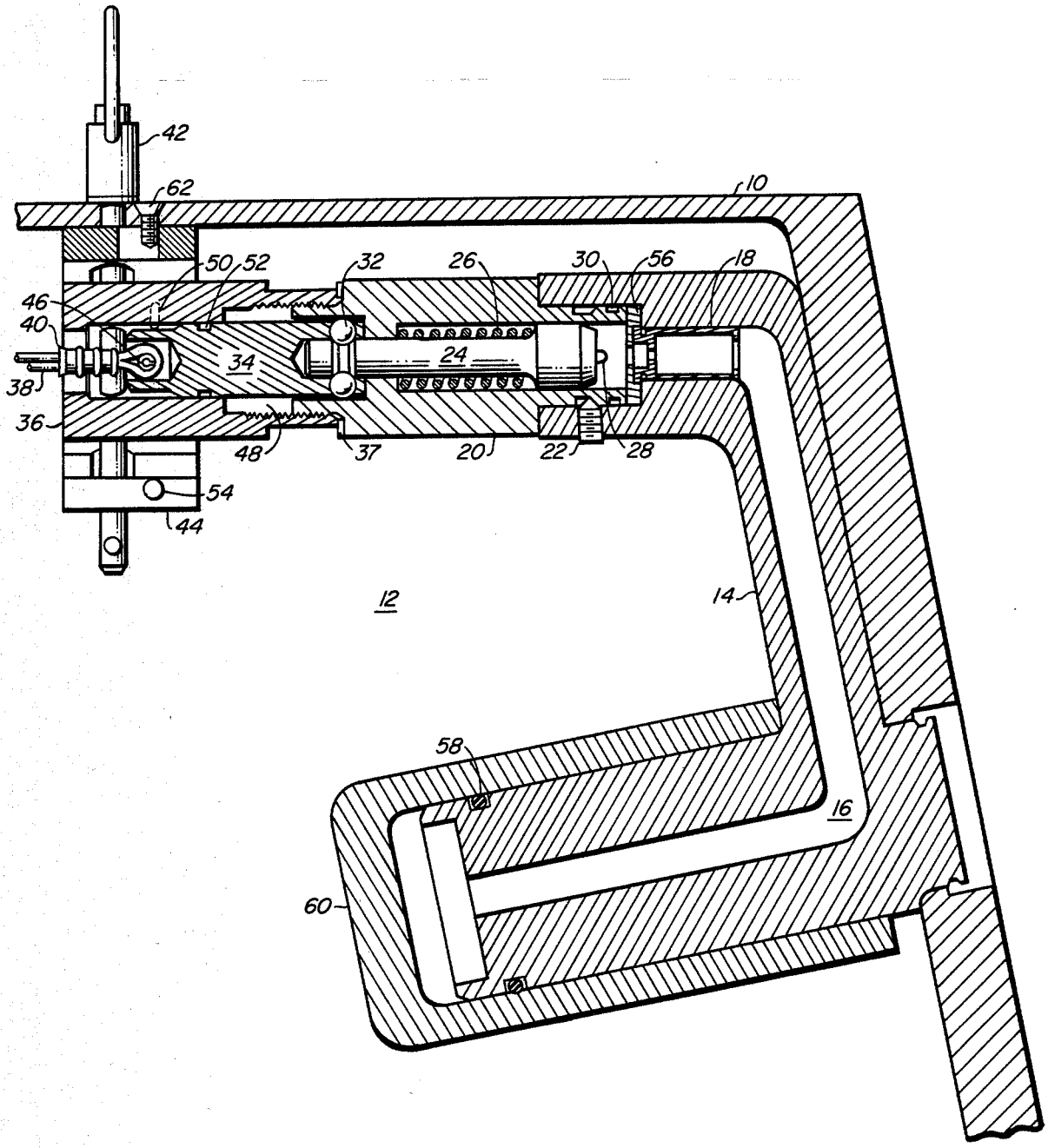
FIG. 1 is a cross-sectional view of the present invention.

In FIG. 1, an explosive actuator similar to an explosive actuator such as used in the present invention is shown in cross-sectional detail. A housing 10 is the outer covering of the ordnance to be deployed. An in-line tail fin firing device explosive actuator 12 is mounted in the tail end of housing 10. Actuator 12 has a transfer tube 14 to provide a U-shaped passage 16 which has a pressure cartridge 18 located at one end of U-shaped pressure tube 16. Mounted in the end externally to pressure cartridge 18 is an actuator pin housing 20 which is held in place by a fastener 22, such as a set screw. Within actuator pin housing 20 is an actuator pin 24, also considered a firing pin. Actuator pin 24 is spring-loaded by a compression spring 26 which, in the position shown, is fully relaxed. Actuator pin 24 has a nub 28 which is aligned to rupture pressure cartridge 18 when propelled into it with sufficient preset force. Packing 30 is provided in the form of an O-ring or similar mechanism to assure a snug pressure-tight seal between actuator pin housing 20 and transfer tube 14.

Actuator pin 24 is held in place to prevent it reaching pressure cartridge 18 by locking balls 32. The U-shape expels the tail fin device in the same general direction as the direction of actuator pin 24 needed to release locking balls 32. Locking balls 32 are set in the recessed end of actuator pin 24 as shown and held in place by a ball retainer 34. A cap 36 is mounted around ball retainer 34 and to actuator pin housing 20. In FIG. 1, cap 36 is shown screwed onto actuator pin housing 20 and cushioned by a gasket 37 which holds a snug fit between the two. A lanyard 38 is connected to ball retainer 34 via a sleeve 40. Lanyard 38 can be any suitable high strength cord such as wire rope. Locking sleeve 40 in a fixed position within cap 36 is a safety pin 42 which is fitted within a hole through cap 36 and, for mounting convenience, can also be inserted through a clamp 44 which is mounted externally to cap 36. Sleeve 40 holds lanyard 38 to a pin spring 46 which is part of ball retainer 34. When ball retainer 34 is extracted by lanyard 38, balls 32 are fixed in place until they reach space 48 which permits them to fall free of actuator pin 24.

When locking balls 32 fall free, actuator pin 24 is thrust forward by compression spring 26 and nub 28 ruptures pressure cartridge 18. To prevent movement of ball retainer 34, even after safety pin 42 has been removed, a shear pin 50 can be used to further lock ball retainer 34 in position. An O-ring 52 is used as lubricated packing to prevent binding of ball retainer 34 due to friction. Clamp 44 is held in position by screw 54. Washer 56 can be placed between actuator pin housing 20 and pressure cartridge 18 to assure a snug fit. O-ring 58 is placed around the far end of transfer tube 14 to facilitate ease of movement of a piston pusher assembly 60. Clamp 44 can be held against housing 10 by means of screws 62.

Figure 2:
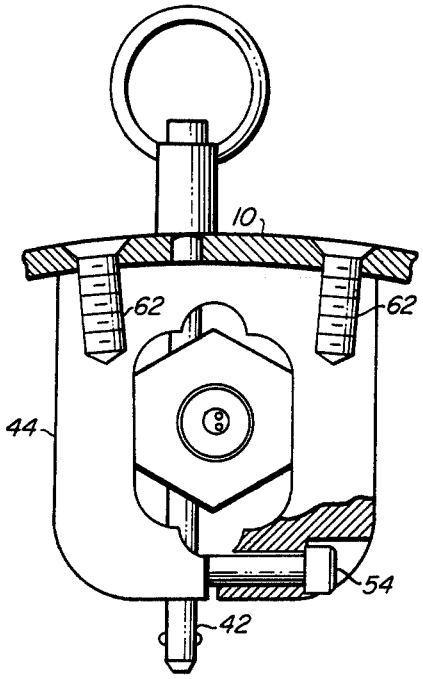
FIG. 2 is an end-on view of a section of the present invention.

FIG. 2 shows an end-on view of screw clamp 44 with partial cutaways and partial openings of screw locations and firing pin locations. As shown, safety pin 42 is offset within clamp 44 to avoid being directly in the center of the line of motion.

Figure 3:
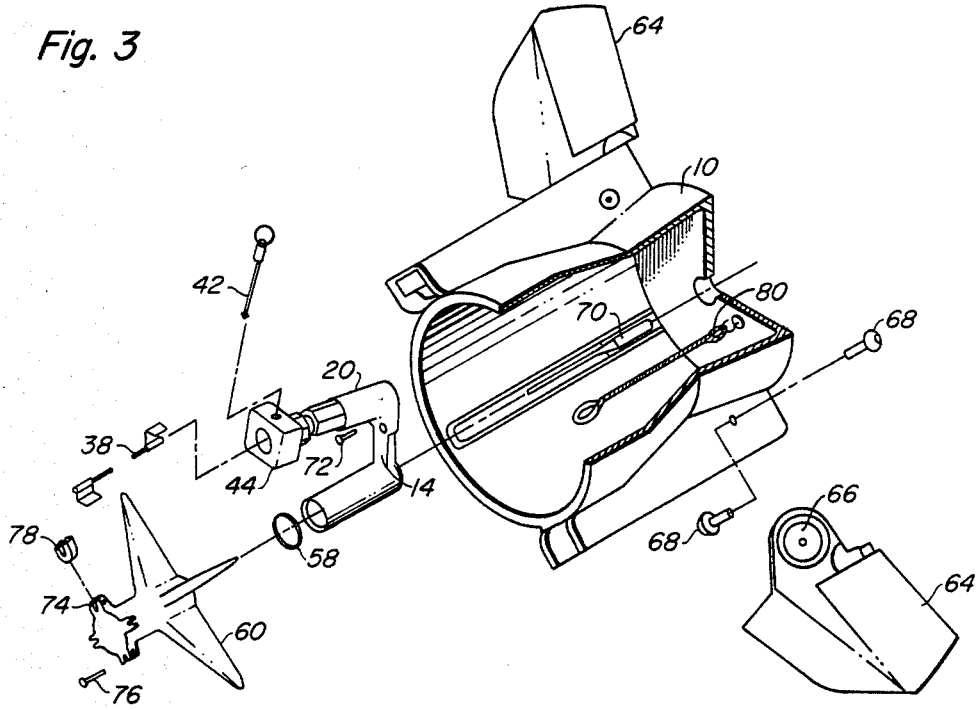
FIG. 3 is an exploded view of the present invention.

FIG. 3 is an exploded view of the present invention. In addition to numbers referring to portions of previously identified components, fin assemblies 64 are mounted through bearings 66 which permit rotation of fin assembly 64 to housing 10 via pivot bolts 68. Pivot bolts 68 are self-locking screws. Within housing 10 a groove guide 70 is shown which permits fin assemblies 64 to fit within housing 10 while the store is being carried. Within FIG. 3, actuator pin housing 20 is shown screwed to outer housing 10 via screws 72. Fin assemblies 64 are mounted to tail assembly pivot bolts 68 and secured by shear rivets 76 to the piston pusher assembly 60.

Piston pusher assembly 60 has brackets 74 with grips 78. Grips 78 may be made of rubber. The leading edges of fin assemblies 64 are held by grips 78 prior to firing. Shear rivets 76 may also be used as a means to hold fin assemblies 64. When pusher piston 60 is thrust forward, grips 78 rotate fin assemblies 64 to the extended or open position where they lock into position. Shear rivets 76, if present, are sheared by the motion of pusher piston 60. A restraining cable 80 limits the length of stroke of piston pusher assembly 60.

Upon deployment from an aircraft, lanyard 38 has a preselected amount of slack which is extended. When lanyard 38 is pulled, housing 10 has dropped to a safe distance from the aircraft for the tail fins to deploy.

Figure 4:
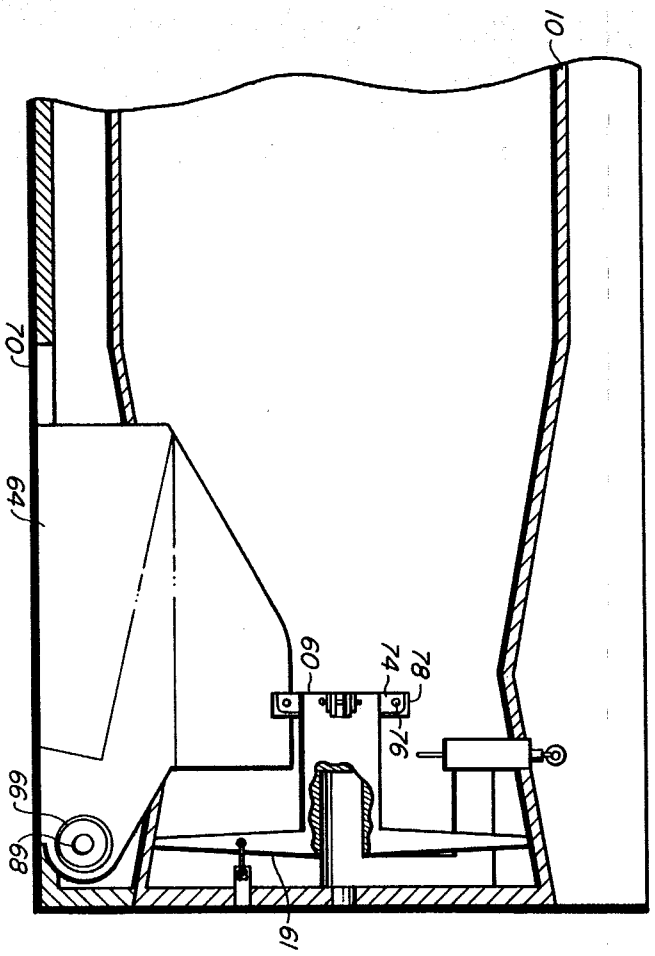
FIG. 4 is a partial cross-section of the present invention assembled.

FIG. 4 is a partial cross-section of the present invention. Housing 10 has fin assemblies 64 inside and held to piston pusher assembly 60 via grips 78 and shear rivets 76. Grips 78 and shear rivets 76 are held in place by brackets 74 on piston pusher assembly 60. As piston pusher assembly 60 is driven forward, grips 78 rotate fin assemblies 64 about bearings 66 held by pivot bolts 68. Shear rivets 76 shear and the extensions 61 of piston pusher assembly 60 complete rotation of fin assemblies 64 through groove guides 70 into the extended position. Fin assemblies 64 may have a catch, not shown, to lock them in the extended position. Depending on fin design, air pressure may be adequate to hold them open.

It is obvious to those skilled in the art that numerous modifications to the above can be made.

What is claimed is:

1. A tail fin firing device for use in a housing containing deployable tail fins comprising:

a pressure cartridge capable of creating a preset gas pressure;

a spring loaded actuator pin mounted next to said cartridge to trigger pressure release from said cartridge;

a ball retainer with locking balls held to said spring loaded actuator pin by said locking balls to grip said actuator pin until said locking balls release by movement of said ball retainer a predetermined distance;

a lanyard tied to said mounting bar, placed to pull in the direction of said actuator pin movement required to release said locking balls;

a pressure tube connected to said pressure cartridge to direct said gas pressure from said cartridge;

a pusher piston mounted to said pressure tube such that said pusher piston moves when pressure is present above a preset level in said pressure tube; and means for holding said deployable tail fins by said pusher piston until pusher piston moves a set distance.

2. A tail fin firing device for use in a housing containing deployable tail fins as described in claim 1 where said pressure tube comprises a U-shaped tube, said U-shape defined as directing said tail fin device in the same general direction as the direction of movement needed by said actuator pin to release said locking balls.

3. A tail fin firing device for use in a housing containing deployable tail fins as described in claim 1 further comprising a restraining cable mounted between said housing and said pusher piston to limit the length of stroke of said pusher piston.

4. A tail fin firing device for use in a housing containing deployable tail fins as described in claim 1 further comprising a spring connected to said actuator pin to impel said actuator pin into said pressure cartridge such that said spring has to be compressed before said actuator pin will trigger said pressure cartridge.

5. A tail fin firing device for use in a housing containing deployable tail fins as described in claim 4 where said pressure tube comprises a U-shaped tube, said U-shape defined as directing said tail fin device in the same general direction as the direction of movement needed by said actuator pin to release said locking balls.

6. A tail fin firing device for use in a housing containing deployable tail fins as described in claim 1 further comprising a safety pin placed next to said spring loaded actuator pin such that said actuator pin may not move until said safety pin is removed.

7. A tail fin firing device for use in a housing containing deployable tail fins as described in claim 6 where said pressure tube comprises a U-shaped tube, said U-shape defined as directing said tail fin device in the same general direction as the direction of movement needed by said actuator pin to release said locking balls.

8. A tail fin firing device for use in a housing containing deployable tail fins as described in claim 6 further comprising a spring connected to said actuator pin to impel said actuator pin into said pressure cartridge such that said spring has to be compressed before said actuator pin will trigger said pressure cartridge.

9. A tail fin firing device for use in a housing containing deployable tail fins as described in claim 8 further comprising a restraining cable mounted between said housing and said pusher piston to limit the length of stroke of said pusher piston.

10. A tail fin firing device for use in a housing containing deployable tail fins as described in claim 8 where said pressure tube comprises a U-shaped tube, said U-shape defined as directing said tail fin device in the same general direction as the direction of movement needed by said actuator pin to release said locking balls.

11. A tail fin firing device for use in a housing containing deployable tail fins as described in claim 10 further comprising a restraining cable mounted between said housing and said pusher piston to limit the length of stroke of said pusher piston.

* * * * *